US005869923A

United States Patent [19]

Strzelichowski et al.

[11] Patent Number: 5,869,923

[45] Date of Patent: Feb. 9, 1999

[54] CRT WITH NECK-GRIPPING BEAM-CORRECTING FERRITE-RING ASSEMBLY

[75] Inventors: Wieslaw Strzelichowski, Farmington Hills, Mich.; Samuel Sunwhee Chung, Knoxville, Tenn.

[73] Assignee: Philips Electronics North America, New York, N.Y.

[21] Appl. No.: 767,098

[22] Filed: Dec. 4, 1996

[51] Int. Cl.[6] ..... H01J 29/70

[52] U.S. Cl. ..... 313/440; 313/437; 313/428; 313/412; 315/368.24; 348/807

[58] Field of Search ..... 313/440, 437, 313/482, 428, 412; 411/269, 306; 315/370, 368.11, 368.27, 368.24; 335/210, 212, 213; 348/807, 831

[56] References Cited

U.S. PATENT DOCUMENTS

| | | | |
|---|---|---|---|
| 4,211,960 | 7/1980 | Barten et al. | 315/368 |
| 4,220,897 | 9/1980 | Barten et al. | 315/368.27 |
| 4,641,062 | 2/1987 | Pons | 315/370 |
| 5,105,120 | 4/1992 | Nishioka et al. | 313/440 |
| 5,191,253 | 3/1993 | Kang | 313/440 |
| 5,227,692 | 7/1993 | Lee | 313/431 |

FOREIGN PATENT DOCUMENTS 925028859 2/1992 Sweden .

*Primary Examiner*—Jay M. Patidar
*Attorney, Agent, or Firm*—Robert J. Kraus

[57] ABSTRACT

A rigid ferrite-containing ring and plastic holder are described for mounting on the neck of a color cathode ray tube (CRT) which ring is to be custom magnetized in order to provide correction of static convergence, color purity and/or frame errors in the CRT. The holder is provided with depressible tabs which releasably secure the ring to the holder. The holder is mounted on the neck of the CRT in the vicinity of the main focusing gap of the electron gun of the CRT, using an adhesive.

18 Claims, 3 Drawing Sheets

CRT WITH NECK-GRIPPING BEAM-CORRECTING FERRITE-RING ASSEMBLY

CROSS REFERENCE TO RELATED APPLICATIONS

U.S. patent application Ser. No. 08/767,097, filed Dec. 4, 1996 relates to a method and apparatus for magnetizing a magnetic ring for static convergence correction of a cathode ray tube (CRT), which is suitable for use with the ferrite ring and holder which are the subject matter of the present application.

BACKGROUND OF THE INVENTION

This invention relates to cathode ray tubes (CRTs) for color television and other color displays, such as data/graphic displays and more particularly relates to a magnetic ferrite ring for static convergence correction of such a CRT, and to a holder for affixing such a ring to the neck of a CRT.

CRTs for color television and related applications employ a display screen made up of a repetitive pattern of triplets of cathodoluminescent phosphor elements, each triplet including one element for each of the primary colors red, blue and green. Conventionally, the elements are in the form of closely spaced vertical stripes. The screen is activated by simultaneously sweeping three electron beams across the display screen, each beam modulated in intensity in accordance with a display signal corresponding to one of the three primary color components (red, blue, green) of the image to be displayed. In order to insure that each of the beams lands only on the phosphor elements of the corresponding color, a mask having a large number of apertures is positioned a short distance behind the screen in a manner so that there is registration between the electron beams, the apertures in the mask and the corresponding phosphor elements on the screen.

In a conventional color CRT, the number of individual picture elements or pixels, which are defined by the apertures in the mask, is typically about 250,000 or more. The large number and small size of these pixels enables the eye of the observer of the display to integrate the separate red, blue and green elements into a full color image at normal viewing distances.

Registration between the mask apertures and screen elements is critical to obtaining a high quality display image. Such registration is achieved by mounting the aperture mask behind the glass display window, and then using the mask as a photomask to form the screen in situ on the window using photolithographic techniques. The mask and screen are thus "married", and remain together throughout the remainder of the manufacturing process and operating life of the tube.

Accurate placement and alignment of the electron gun in the neck of the CRT envelope are also critical to achieving registration of the electron beams with the proper phosphor elements on the screen. One measure of such registration is the "static convergence", defined as the condition in which the three electron beams overlap in the center of the display screen, in the absence of any beam deflection current.

It will be appreciated that despite careful controls imposed at every step of the manufacturing process, some incidences of misalignments will inevitably occur. Once the manufacturing process has been completed, there is no longer any opportunity to adjust the alignment of the mechanical components inside the CRT envelope. However, the alignment of the electron beams is customarily adjusted by placing permanent magnets in proximity to the electron gun, to correct static convergence, as well as color purity and frame errors.

Such corrections have in the past been carried out manually, by adjusting the positions of a series of multipole magnetic ferrite rings with respect to the beams and to each other, resulting in significant labor costs as well as human errors.

One approach to improving such static convergence correction is to replace the manually adjustable series of ferrite rings with a single flexible ferrite tape, wound around the outside of the neck of the CRT, and custom magnetized to achieve convergence correction. A typical width for such a tape is about 2 inches.

Drawbacks to this approach include the large amount of plasticizer needed to achieve the required flexibility, necessitating a larger than desired thickness, and leading to crack formation on drying of the plasticizer. Furthermore, for a given neck diameter, as the size of the display screen is increased, the size and mass of the tape must also be increased. However, increasing the width of the tape by as little as ⅛ inch could result interference of the magnetic field from the tape interfering with the focus of the electron gun .

U.S. Pat. No. 4,220,897 describes another approach to correcting convergence errors, as well as color purity and frame errors, which involves inducing a customized magnetization pattern in a convergence correcting device such as a single metal alloy ring, located for example inside the top cup of the electron gun.

While such method represents a significant improvement over the manual adjustment of premagnetized rings on the neck of the CRT, in practice it has been found to result in variations from CRT to CRT, due to positional variations of the magnetization apparatus relative to the rings, and to variations in the gap between the nearly abutting ends of the internal magnetic rings. In addition, the internal magnetic rings are made of a CoFeVCr alloy, which although easier to magnetize than other suitable ring materials, such as ferrite, is nevertheless considerably more expensive to purchase and fabricate.

As the competition between various CRT manufacturers intensifies, it becomes increasingly important to try to minimize as much as possible such variations, and to do so at minimal cost.

OBJECTS AND SUMMARY OF THE INVENTION

Accordingly, it is an object of the invention to provide a magnetizable ring for static convergence correction of a color CRT which overcomes the disadvantages of the prior art.

It is another object of the invention to provide such a ring for achieving color purity and for correcting frame errors, as well as static convergence errors, in a color CRT.

It is another object of the invention to provide such a ring which contains ferrite and which is rigid and self supporting.

It is another object of the invention to provide a holder for securing such a ferrite-containing ring to the outside of the neck of a color CRT.

It is another object of the invention to provide such a holder which is easily securable to and removable from the neck of the CRT during the manufacturing process.

In accordance with the invention, a ferrite-containing ring (herein "ferrite ring") is provided, which ring is susceptible to a custom magnetization for the correction of static convergence errors, as well as color purity and frame errors, of a color CRT.

As used herein, the term "ring" is meant to include any rigid and self supporting element having an aperture suitable to accommodate a holder for securing the ring to the neck of a CRT. Preferably, such an aperture has an approximately circular cross section, and the ring has an approximately cylindrical shape.

Also in accordance with the invention, a holder is provided for securing the ring to the outside of the neck of a color CRT, which holder has means for releasably securing the ring to the holder, and which holder has an aperture suitable to accommodate the neck of a color CRT. Preferably, such an aperture has an approximately circular cross section, and the holder has an approximately cylindrical shape. Preferably, the securing means comprise depressible tabs which releasably secure the ring to the holder.

BRIEF DESCRIPTION OF THE DRAWINGS

The invention will now be described in detail with reference to the drawings, in which.

DESCRIPTION OF THE PREFERRED EMBODIMENTS

Figure 1:
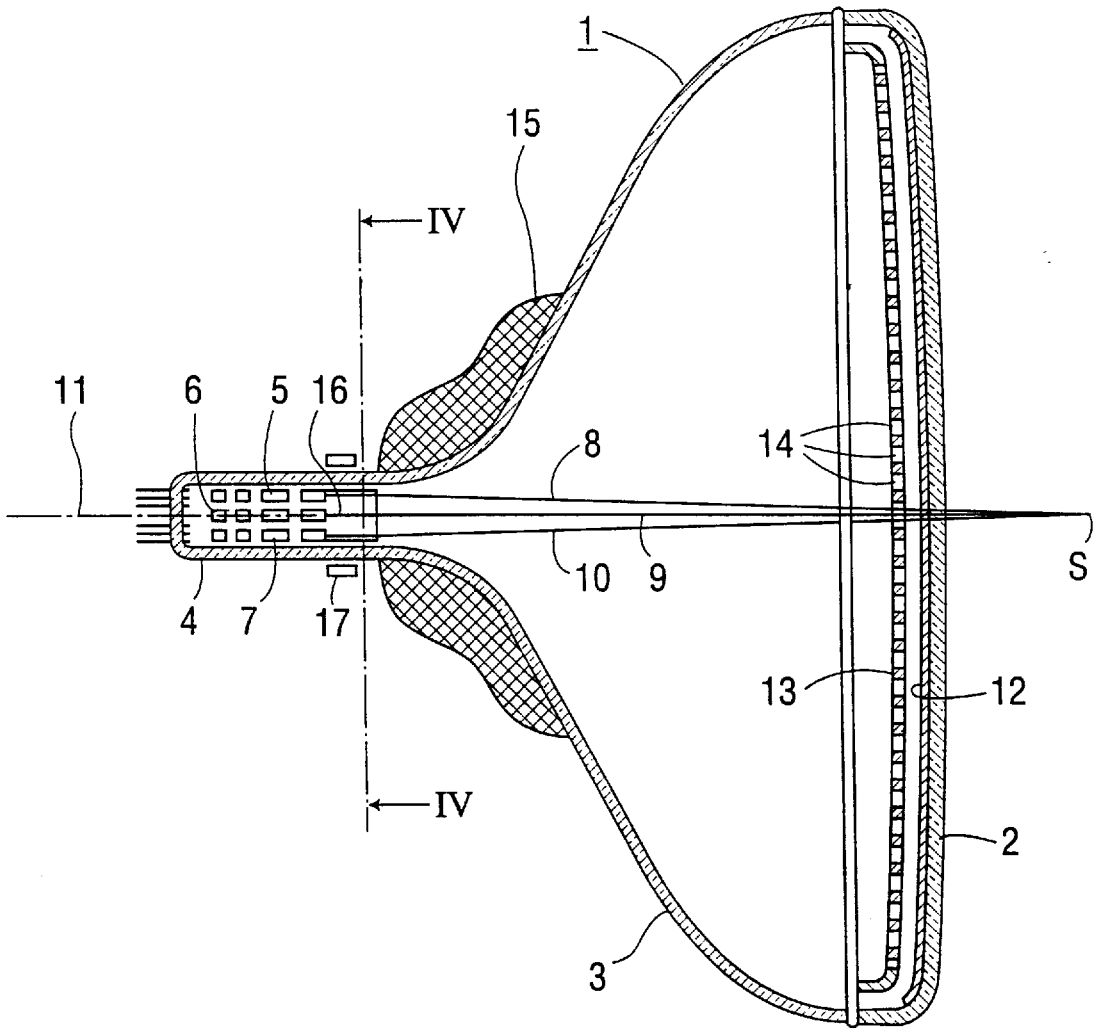
FIG. 1 Prior Art
FIG. 1 is a diagrammatic sectional view of a known color CRT of the "in-line" type having an external static convergence ring.

FIG. 1 is a diagrammatic sectional view of a known color display tube of the "in-line" type. Three electron guns 5, 6 and 7, for generating the electron beams 8, 9 and 10, respectively, are accommodated in the neck 4 of a glass envelope 1 which is composed of a display window 2, a funnel-shaped part 3 and a neck 4. The axes of the electron guns 5, 6 and 7 are situated in one plane, the plane of the drawing. The axis of the central electron gun 6 coincides substantially with the tube axis 11. The three electron guns are seated in a sleeve 16 which is situated coaxially in the neck 4. The display window 2 has on the inner surface thereof a large number of triplets of phosphor lines. Each triplet comprises a line of a phosphor luminescing green, a line of a phosphor luminescing blue, and a line of a phosphor luminescing red. All of the triplets together constitute a display screen 12. The phosphor lines are normal to the plane of the drawing. A shadow mask 12, in which a very large number of elongate apertures 14 are provided through which the electron beams 8, 9 and 10 pass, is arranged in front of the display screen 12. The electron beams 8, 9 and 10 are deflected in the horizontal direction (in the plane of the drawing) and in the vertical direction (at right angles thereto) by a system 15 of deflection coils. The three electron guns 5, 6 and 7 are assembled so that the axes thereof enclose a small angle with respect to each other. As a result of this, the generated electron beams 8, 9 and 10 pass through each of the apertures 14 at said angle, the so-called color selection angle, and each impinge only upon phosphor lines of one color.

A display tube has a good static convergence if the three electron beams, when they are not being deflected, intersect each other substantially in the center of the display screen. It has been found, however, that the static convergence often is not good, no more than the frame shape and the color purity, which may be -the result of an insufficiently accurate assembly of the guns, and/or sealing of the electron guns, in the tube neck. In order to produce the static convergence, so far, externally adjustable correction units have been added to the tube. They consist of a number of pairs of multipoles consisting of magnetic rings, for example four two-poles (two horizontal and two vertical), two four-poles and two six-poles. The rings of each pair are coupled together by means of a pinion transmission, with which the rings are rotatable with respect to each other to an equal extent. By rotating the rings with respect to each other and/or together, the strength and/or direction of the two-, four- or six-pole field is adjusted. It will be obvious that the control of a display tube with such a device is complicated and time-consuming. Moreover, such a correction unit is material-consuming since, for a combination of multipoles, at least eight rings are necessary which have to be provided around the neck so as to be rotatable with respect to each other.

In accordance with the invention, such manually adjustable rings are replaced by a single magnetic ring assembly 17, which includes a rigid ferrite ring and a holder, which ring has been magnetized by the two step method of coarse and fine convergence correction as described in concurrently filed U.S. patent application Ser. No. 08/767,097.

The amount of ferrite in the ring must be sufficient to provide the magnetization needed for convergence correction. In general, the amount of ferrite may range from about 30 to 99.9 percent or more. The ring is typically formed by combining a mixture of ferrite particles with binder and plasticizer, pressing the mixture into the desired shape, and heating to drive off the volatile components and to weld the particles into a rigid, self supporting body. As is known, such a heating process results is some shrinkage of the ring, so the initial dimensions of the ring are preferably chosen so that after shrinkage, the approximate desired dimensions will be achieved, to minimize or avoid the need for machining to the final dimensions.

A particular advantage of such a ring of the invention over the flexible tape of the prior art is that a much lower amount of plasticizer is required, leading to reduced cost and much lower incidences of cracking. Another advantage of such a ring is that the density of the ferrite is much higher, so that a more compact and powerful ring is possible. Typical widths for such a ring are from about ¼ to ⅜ inch. Thus, the ring can be placed so that the likelihood of interference with the focus of the electron gun is negligible. In addition, the power of the ring enables a single standard size for CRTs having a standard neck size, regardless of screen size.

Figure 2:
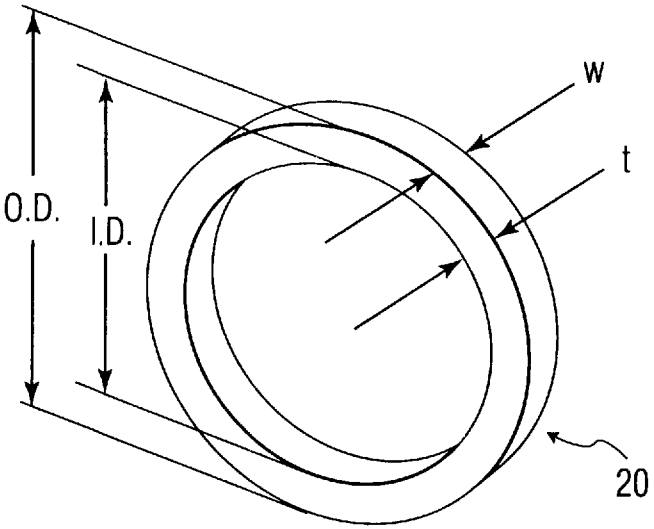
FIG. 2 is perspective view of a ferrite ring of the invention.

FIG. 2 shows a typical ring 20 of the invention, having a width w, a thickness t, an inside diameter I.D., and an outside diameter O.D. Except for the I.D., which must allow for a slip fit onto the holder, the dimensions are not critical, and may vary over a wide range.

Typical dimensions of rings for use with holders of the type shown in FIG. 2 and for different standard neck sizes of CRTs are given below in Table I.

TABLE I

| Neck diam. | I.D. | O.D. | w | t |
|---|---|---|---|---|
| 22 mm | 23 | 27 | 6 | 2 |
| 28 mm | 30 | 36 | 8 | 3 |

TABLE I-continued

| Neck diam. | I.D. | O.D. | w | t |
|---|---|---|---|---|
| 36 mm | 38 | 44 | 10 | 3 |
| 50 mm | 52 | 60 | 10 | 4 |

Figure 3:
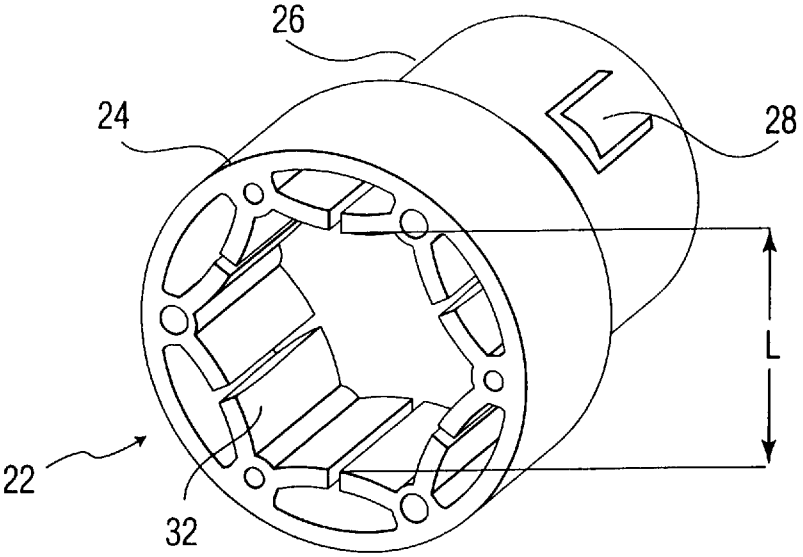
FIG. 3 is a perspective view of a ring holder of the invention.

FIGS. 2 and 3 show perspective and side elevation views, respectively, of one embodiment of a ring holder 22 of the invention, including a cylindrical front portion 24 and a smaller cylindrical rear portion 26. In this embodiment, the ring holder is fabricated as a molded thermoplastic resin, but could also be molded or machined from a ceramic or non-magnetic metallic material. The front portion 24 has a series of tabs 32 extending into the interior of the holder. The tabs are resilient, and their free ends lie on a circle whose diameter L is slightly smaller than the outer diameter of the neck of the CRT, so that when the holder is inserted onto the CRT neck, the tabs are deflected slightly, and the natural spring bias of the resin serves to secure the holder to the neck.

Figure 5:
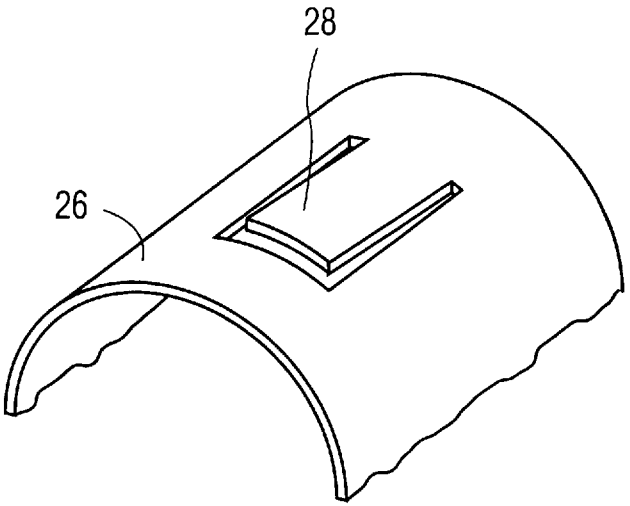
FIG. 5 is an enlarged portion of the perspective view of FIG. 3, showing the ring locking mechanism of the holder in detail.
Figure 4:
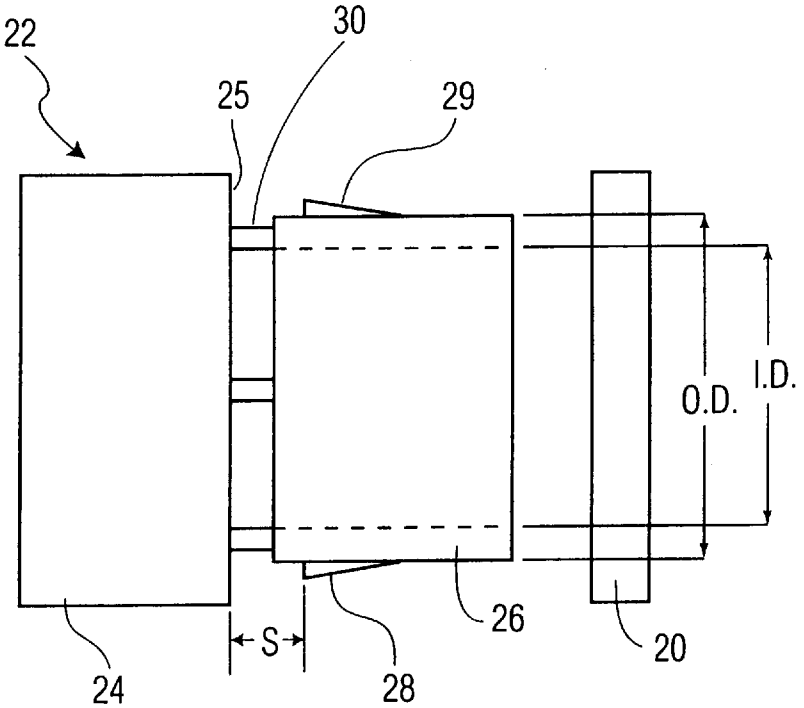
FIG. 4 is a side elevation view of ring/ring holder assembly of the invention.

The rear portion 26 of the holder 22 has an inside diameter I.D. slightly larger than the neck of the CRT, to allow for ease of insertion, but to prevent excessive movement of the assembly 17 relative to the neck. Molded into the rear portion 26 are two depressible ring locks 28 and 29. A more detailed view of ring lock 28 is shown in FIG. 5. These ring locks are simple tabs whose free ends extend above the outer surface of the rear portion 26. When the ring is inserted onto the holder, these ring locks are depressed to allow passage of the ring, and then return to their original position, in which the free ends of the tabs prevent the ring from sliding backward along the surface of the holder. In addition, the larger diameter of the front portion 24 prevents the ring from sliding forward. In order to prevent excessive movement of the ring on the holder, the distance s between the end of the tabs 28,29 and the rear surface 25 of the front portion 24, should be only slightly larger than the width w of the ring. The front and rear portions of the holder are joined together by ribs 30.

Typical dimensions for the holder to be used with the ring dimensions set forth above in Table 1, are set forth below in Table 2.

TABLE 2

| Neck Diam. | I.D. | O.D. | s | L |
|---|---|---|---|---|
| 22 mm | 22 | 27 | 5 | 10 |
| 28 mm | 28 | 36 | 5 | 10 |
| 36 mm | 36 | 44 | 5 | 10 |
| 50 mm | 50 | 60 | 5 | 10 |

The holder is positioned on the neck of the CRT so that the ring is approximately adjacent to the gap between the two main focusing electrodes (usually the focus electrode and the anode) of the electron gun, conventionally referred to as the main lens gap, where the ring can have a maximum effect on the paths of the electron beams, without interfering with their focus. After the position of the deflection unit is adjusted, both the deflection unit and the holder are fixed in place with a latex paint.

The ring is then custom magnetized using the method and apparatus described in concurrently filed U.S. patent application Ser. No. 08/767,097 referred to above, the contents of which are incorporated herein by reference. Such custom magnetization imprints into the ring in an 8-pole configuration the magnetic correction information needed to achieve static convergence of the three electron beams over the life of the CRT.

The invention has been described in terms of a limited number of embodiments. Other embodiments and variations of embodiments will become apparent to those skilled in the art, and are intended to be encompassed within the scope of the appended claims.

What we claim as our invention is:

1. A ring-and-holder assembly for correcting positional errors of electron beams produced within a color cathode-ray tube, said assembly comprising:

a magnetizable ring susceptible to custom magnetization for the correction of said positional errors; and a holder for securing said ring to an annular outer surface of a portion of the cathode-ray tube, the surface having a predetermined diameter, the holder including:

an aperture for accommodating the portion of the cathode-ray tube;

a plurality of depressible tabs arranged within the aperture for pressing against the outer surface, said tabs defining an annulus with a diameter smaller than said predetermined diameter when not pressing against said outer surface; and a ring-locking arrangement for securing the magnetizable ring to the holder.

2. The ring of claim 1 which the aperture has an approximately circular cross section.

3. The ring of claim 1 in which the ring has an approximately cylindrical shape.

4. The ring of claim 1 in which the ring comprises from about 30 to 99.9 percent ferrite.

5. A holder for securing a magnetizable ring to an annular outer surface of a neck portion of a cathode-ray tube, the surface having a predetermined diameter, the holder including:

an aperture for accommodating the neck portion of the cathode-ray tube;

a plurality of depressible tabs arranged within the aperture for pressing against the outer surface, the tabs defining an annulus with a diameter smaller than said predetermined diameter when not pressing against said outer surface; and a ring-locking arrangement for releasably securing the magnetizable ring to the holder.

6. The holder of claim 5 in which the aperture has an approximately circular cross section.

7. The holder of claim 6, said holder having an approximately cylindrical shape.

8. The holder of claim 7, said holder including a front portion and a rear portion, the front portion having a larger outside diameter than the rear portion.

9. The holder of claim 5, said holder comprising a molded thermoplastic resin.

10. A color cathode-ray tube assembly including:

an envelope containing an electron-gun arrangement for producing a plurality of electron beams;

a magnetizable ring susceptible to custom magnetization for the correction of positional errors of said electron beams; and a holder for securing said ring to an annular outer surface of a portion of the cathode-ray tube envelope, the surface having a predetermined diameter, the holder including:

an aperture for accommodating the portion of the cathode-ray tube;

a plurality of depressible tabs arranged within the aperture for pressing against the outer surface, said tabs defining an annulus with a diameter smaller than said predetermined diameter when not pressing against said outer surface; and a ring-locking arrangement for securing the magnetizable ring to the holder.

11. The assembly of claim 10, in which the ring has an aperture with an approximately circular cross section.

12. The assembly of claim 11 in which the ring has an approximately cylindrical shape.

13. The assembly of claim 10 in which the ring comprises from about 30 to 99.9 percent ferrite.

14. The assembly of claim 10 in which the aperture of the holder has an approximately circular cross section.

15. The assembly of claim 14 in which the holder has an approximately cylindrical shape.

16. The assembly of claim 15, said assembly including a front portion and a rear portion, the front portion having a larger outside diameter than the rear portion.

17. The assembly of claim 10 in which said holder comprises a molded thermoplastic resin.

18. The assembly of claim 10 in which the ring is custom magnetized to correct a static convergence error of the cathode-ray tube.

* * * * *